US006909448B2

(12) United States Patent
Torisawa

(10) Patent No.: US 6,909,448 B2
(45) Date of Patent: Jun. 21, 2005

(54) IMAGE RECORDING APPARATUS

(75) Inventor: Nobuyuki Torisawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 108 days.

(21) Appl. No.: 10/395,884

(22) Filed: Mar. 25, 2003

(65) Prior Publication Data

US 2004/0017467 A1 Jan. 29, 2004

(30) Foreign Application Priority Data

Mar. 26, 2002 (JP) ..... 2002-085596

(51) Int. Cl.[7] ..... B41J 2/375
(52) U.S. Cl. ..... 347/223
(58) Field of Search ..... 347/223; 219/216; 355/27–29, 400–407; 396/575, 578; 399/119, 252

(56) References Cited

U.S. PATENT DOCUMENTS 6,312,170 B1 11/2001 Agano
6,320,642 B1 11/2001 Ogawa et al.
6,753,949 B2 * 6/2004 Hashiguchi ..... 355/405

* cited by examiner

*Primary Examiner*—K. Feggins
(74) *Attorney, Agent, or Firm*—Sughrue Mion, PLLC

(57) ABSTRACT

The present invention provides an image recording apparatus having a path of travel of a recording material, said apparatus comprising: an exposure section subjecting the recording material to exposure processing so as to form a latent image on the recording material; a heat-developing section subjecting the recording material to heat processing so as to carry out development, which is disposed downstream of the exposure section; a cooling section for cooling the recording material, which is disposed downstream of the heat-developing section; and a storage section for storing the recording material, which is disposed downstream of the cooling section; wherein the heat-developing section includes an exit portion for the recording material, which is provided on the path and disposed at an upper portion of the heat-developing section such that hot air is able to escape from an inside of the heat-developing section.

24 Claims, 9 Drawing Sheets

IMAGE RECORDING APPARATUS

BACKGROUND OF THE INVENTION

1. Field of the Invention

The present invention relates to an image recording apparatus in which a sheet-shaped recording material is subjected to heat-developing processing.

2. Description of the Related Art

As shown in FIG. 8, a conventional image recording apparatus 100 is generally provided with a filter 106 and a discharge opening 110, wherein air in a substantially closed space such as a heat-developing section 102 and a cooling section 104, is filtered by the filter 106, and then, discharged by the fan 108 to the outside of the image recording apparatus 100 via a discharge opening 110.

However, the temperature of a sheet storage portion 112 is raised due to exhaust heat from the cooling section 104. Thus, sheet-shaped recording materials 101, which have been stored in the sheet storage portion, tend to be adversely affected.

Because of the need for gradual cooling of the sheet-shaped recording material 101, which has been discharged from the heat-developing section 102, a structure has been suggested in which the cooling rollers 120 are disposed in a zigzag manner at the cooling section 104, each roller being formed by a pipe 116 that is made of aluminum and a felt 118 that is wound around the pipe 116, as shown in FIG. 9.

In such a case in which the felt 118 is spirally wound around the pipe, a seam or clearance 122 is inevitably formed between one felt edge and the other felt edge, small though it may be. This causes uneven cooling of the sheet-shaped recording material, resulting in development irregularities.

Referring again to FIG. 8, in the conventional image recording apparatus 100, the heat-developing section 102 has an exit opening 114, through which the sheet-shaped recording material 101 is discharged. The exit opening 114 is located at a position approximately in the middle of the heat-developing section 102.

Thus, volatile components in the air, which are emitted from the heat-developed sheet-shaped recording material, inevitably and problematically are trapped in an upper area within the heat-developing section 102.

SUMMARY OF THE INVENTION

It is an object of the present invention to provide an image recording apparatus that can eliminate the aforementioned problems of the prior art.

In order to achieve the object described above, according to one aspect of the present invention, there is provided an image recording apparatus having a path of travel of a recording material, said apparatus comprising: (I) an exposure section subjecting the recording material to exposure processing so as to form a latent image on the recording material; (II) a heat-developing section subjecting the recording material to heat processing so as to carry out development, said heat-developing section being disposed downstream of the exposure section; (III) a cooling section for cooling the recording material, said cooling section being disposed downstream of the heat-developing section; and (IV) a storage section for storing the recording material, said storage section being disposed downstream of the cooling section; (V) wherein the heat-developing section includes an exit portion for the recording material, said exit portion being provided on the path and disposed at an upper portion of the heat-developing section such that hot air is able to escape from an inside of the heat-developing section.

According to another aspect of the present invention, there is provided an image recording apparatus having a path of travel of a recording material, said apparatus comprising: (I) an exposure section subjecting the recording material to exposure processing so as to form a latent image on the recording material; (II) a heat-developing section subjecting the recording material to heat processing so as to carry out development, said heat-developing section being disposed downstream of the exposure section; (III) a cooling section for cooling the recording material, said cooling section being disposed downstream of the heat-developing section; and (IV) a storage section for storing the recording material, said storage section being disposed downstream of the cooling section; (V) wherein the cooling section includes a plurality of cooling rollers, which are disposed along the path, at least part of said cooling rollers having had electrostatic implantation performed thereon.

DESCRIPTION OF THE PREFERRED EMBODIMENT

An embodiment of an image recording apparatus according to the present invention will be described in detail below on the basis of the drawings.

Figure 1:
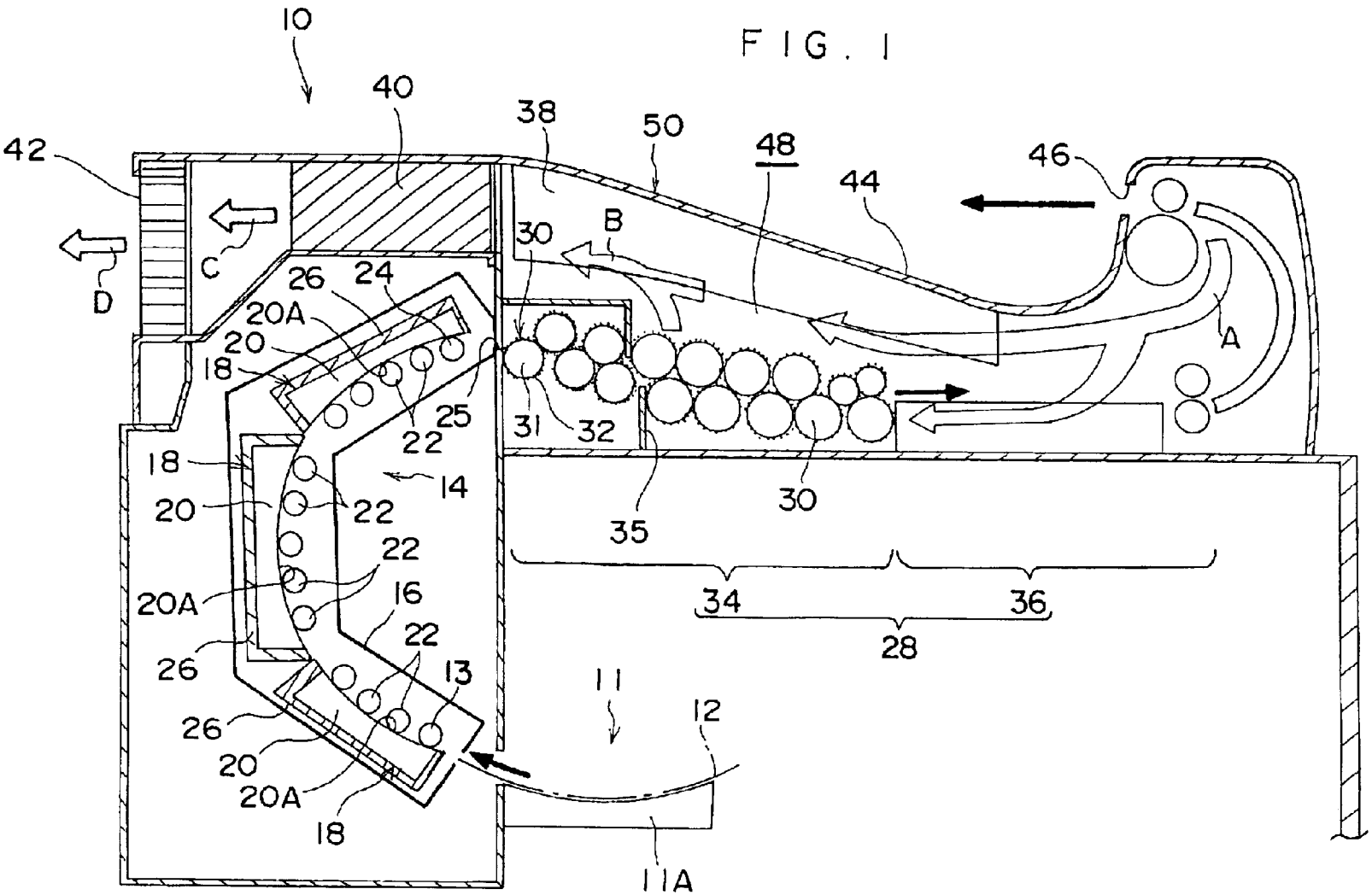
FIG. 1 is a schematic general structural view of an image recording apparatus according to an embodiment of the present invention.

As shown in FIG. 1, the image recording apparatus 10 is provided with an exposure section 11, where a latent image is formed on a sheet-shaped recording material 12.

A heat-developing section 14 is disposed downstream of the exposure section 11. The heat-developing section 14 is a dry-developing type section, which carries out developing processing by heating the sheet-shaped recording material 12. The entire heat-developing section 14 is covered by a casing 16. The region between a first pair of rollers 13 of the heat-developing section 14 and the final stage of the exposure section 11 (the conveying direction downstream side end portion of a guide plate 11A) has a small dimension, which is at least shorter than the conveying direction length of the sheet-shaped recording material 12.

Thus, the leading end of the sheet-shaped material 12, while being scan-exposed in the exposure section 11, enters into the heat-developing section 14.

The casing 16 of the heat-developing section 14 has an arc-shaped path for the sheet-shaped recording material. Three developing units 18 are disposed along this arc. Each developing unit 18 is formed by a heating plate 20 and a plurality of rollers 22. One surface of the heating plate 20 (the surface facing the sheet-shaped recording material 12) is formed as an arc-shaped heating surface 20A. The plurality of rollers 22, together with the heating plate, nip the sheet-shaped recording material 12. The heating plates 20 are heated to predetermined temperatures by respective heating sources (not illustrated). The heating plates 20 are provided with respective heat-insulating covers 26. As needed, controlled temperatures of the heating plates 20 can be changed independently of one another. Further, the heat distribution within each developing unit 18 can be adjusted. Moreover, the rollers 22 receive driving force from respective driving means (not illustrated) and rotate at a constant velocity.

In this way, the sheet-shaped recording material 12, which is inserted into the insertion portion of the developing unit 18, is heated while being conveyed at a predetermined conveying speed. The sheet-shaped recording material 12 receives the amount of heat necessary for development and is heat-developed, until it is discharged.

An exit portion 25 is provided so as to correspond to the final roller 24 of the heat-developing section 14. The exit portion 25 is for discharging the sheet-shaped material 12 from the heat-developing section 14 and is formed at an upper portion of the heat-developing section 14. In this way, the exit portion 25 of the heat-developing section 14 is provided at the upper portion of the heat-developing section, but not at a middle portion thereof. Thus, volatile components can be prevented from being trapped in the heat-developing section 14. As a result, it is difficult for the sheet-shaped recording material 12 to be contaminated and for electronic parts to corrode.

A cooling section 28 is disposed downstream of the heat-developing section 14.

Figure 2:
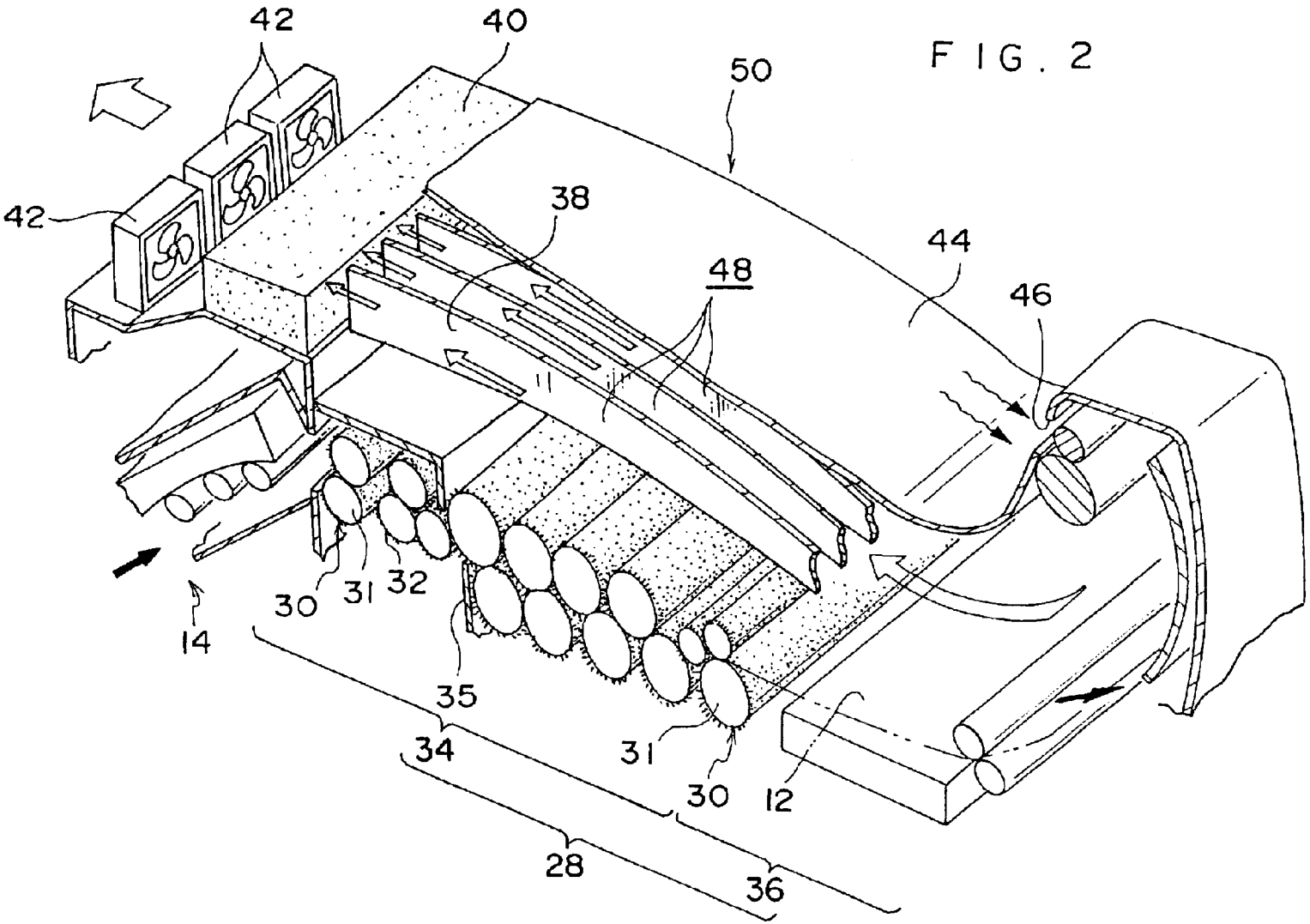
FIG. 2 is a perspective view of a cooling section of the image recording apparatus according to the embodiment.

As show n in FIG. 2, the cooling section 28 is provided with a plurality of cooling rollers 30, which support the sheet-shaped recording material 12. Each cooling roller 30 is formed by a pipe 31, which is made of a material such as aluminum, having the property of being easy to heat and easy to cool. The cooling rollers 30 function to take away heat from the sheet-shaped recording material 12 by contacting the sheet-shaped recording material 12.

Thus, by passing the cooling section 28, the sheet-shaped recording material 12 is cooled and then discharged.

Details of the cooling rollers 30 will be described later.

Here, as shown in FIG. 1, the cooling section 28 possesses a gradual cooling section 34, which is at the earlier stage of the cooling section 28, and a rapid cooling section 36, which is at the latter stage thereof. The gradual cooling section 34 is a region in which the sheet-shaped recording material 12, which has just been developed and has a relatively high temperature (120° C.), is cooled gradually. By passing through the gradual cooling section 34, the temperature of the sheet-shaped recording material 12 is lowered to approximately 70° C. This is preferably a temperature which is lower than the glass transition point of the sheet-shaped recording material 12.

Figure 3:
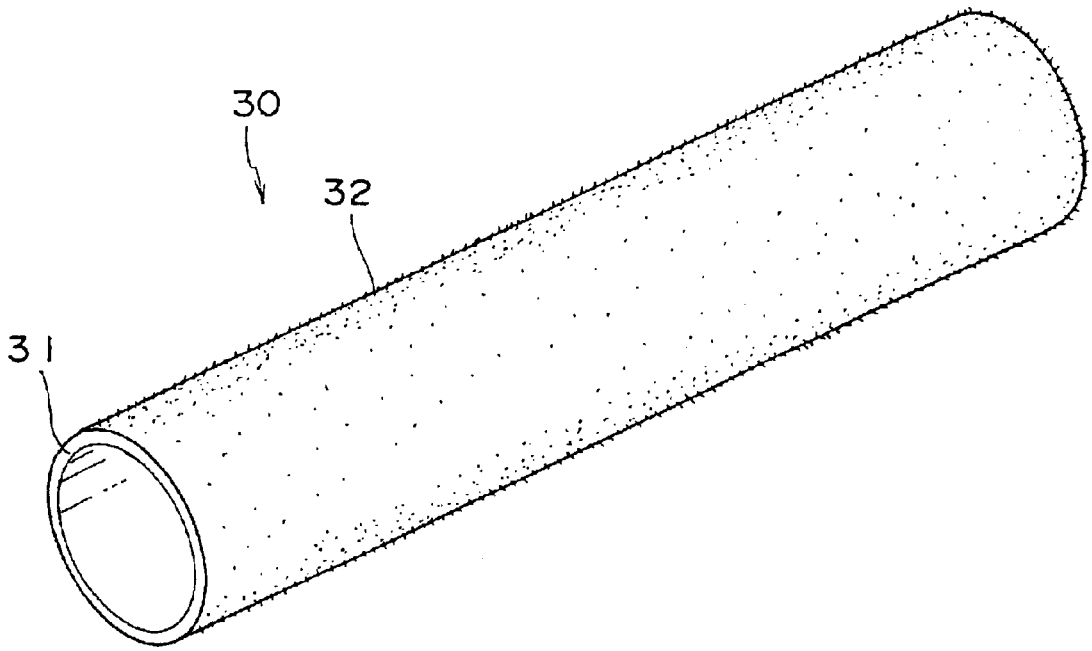
FIG. 3 is a perspective view of a cooling roller with piles electrostatically implanted therein.

As shown in FIG. 3, each of the cooling rollers 30 of the gradual cooling section 34 has piles 32, which are electrostatically implanted in the pipe 31 to serve as a brush member. The length of each pile 32 is preferably within the range of about 0.1 mm~about 4.0 mm, and more preferably, within the range of about 0.5 mm~about 2.5 mm. The thickness of each pile is preferably within the range of about 1.5 denier~about 30.0 denier, and more preferably, within the range of about 2.0 denier~about 7.0 denier. Further, as a material for the piles 32, it is possible to employ a rayon, a nylon, a 66-nylon, a polyester, Nomex and the like. Among these, the 66-nylon is most preferable.

A description will be given of the outline of electrostatic implantation of the piles 32.

Figure 4:
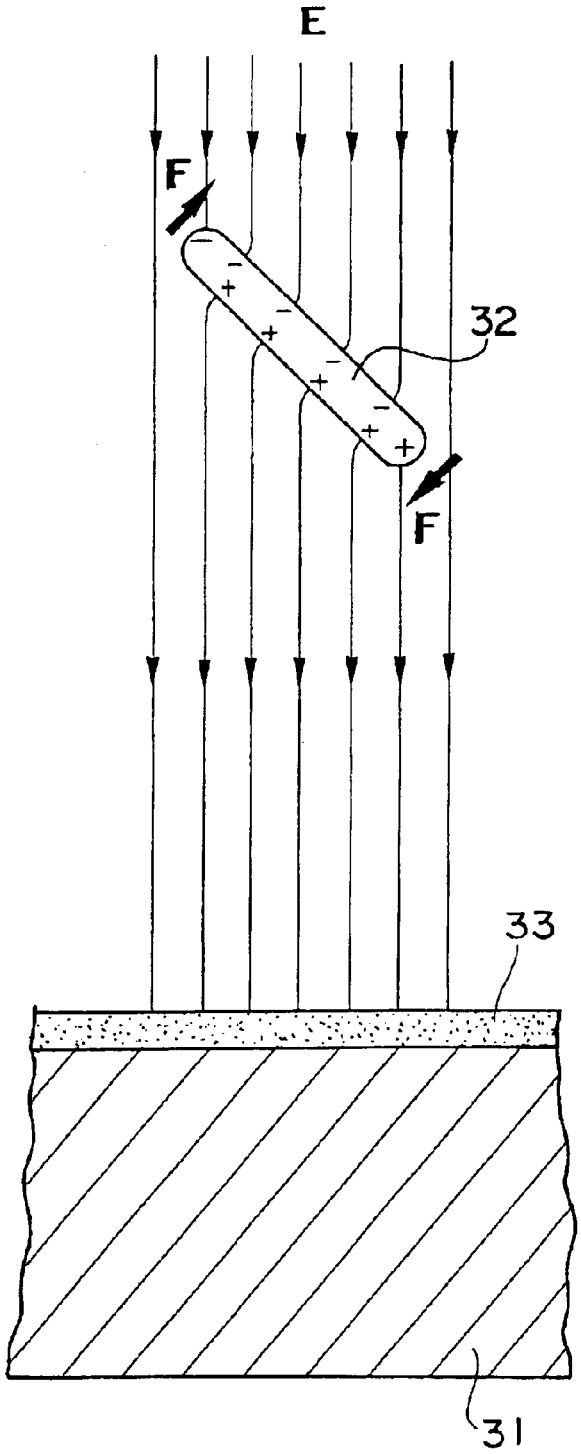
FIG. 4 is an explanatory diagram of electrostatic implanting processing.

As shown in FIG. 4, when a pile 32 is provided in the electric field E, the pile 32 receives a rotational force F from polarization, so that the pile is oriented along electric field lines. Here, by providing a pipe 31 in the electric field E and by controlling a flight path of the pile 32 by an electrode to which voltage is applied, the pile 32 flies toward the pipe 31 due to an electrostatic force generated from the electric field E. Further, by applying an adhesive 33 on the pipe 31 in advance, when one end of the pile 32 abuts the pipe 31, the pile 32 is fixed at its end by means of the adhesive. For example, a water-base acrylic adhesive, an oil-base acrylic adhesive, a water-base epoxy adhesive, an oil-base adhesive or the like is used as a material of the adhesive 33. In every case, the piles are capable of being flocked or implanted perpendicular to the surface of the pipe 31. Thus, if the lengths of the piles 32 are constant, the protruding lengths of the flocked piles should be constant as well.

Post-processing involves filling an appropriate material by utilizing brushing processing and adhesive spray.

In this way, with static electricity flock transplantation technology, the pipe 31 can be uniformly covered with the piles 32. Consequently, gradual cooling processing for uniform cooling can be achieved.

The rapid cooling section 36 (see FIG. 1) is a region in which the temperature of the discharged, sheet-shaped recording material 12 is lowered rapidly. By passing through the rapid cooling section 36, the temperature of the sheet-shaped recording material 12 lowers to approximately 45° C. This is a temperature at which the sheet-shaped recording material can be safely handled by an operator.

Further, as shown in FIGS. 1 and 2, a cover 50, which covers the entire apparatus, is disposed above the cooling section 28 and the heat-developing section 14. A discharge opening 46 is formed at a right-hand side of the cover 50 in FIG. 1. The sheet-shaped recording material 12, which has been cooled in the cooling section 28, is discharged and stored on a sheet storage portion 44 provided on the upper surface of the cover 50.

A ventilation passage 48 is formed above the cooling section 28 and the heat-developing section 14 and below the cover 50. A plurality of cooling fins 38 are provided in the ventilation passage 48, each of which hangs down from an inside surface of the cover 50.

Further, a filter 40 and a plurality of air-cooling fans 42 (serving as an air discharging means) is disposed downstream of the ventilation passage 48. Duty ratio, i.e. ratio of active time to a predetermined time under on-off control, of the air-cooling fans 42 is raised during heat-developing processing of the sheet-shaped recording material 12.

When the air-cooling fans 42 operate, an airflow is formed, flowing from the discharge opening 46 through the ventilation passage 48 and the filter 40 to the outside of the air-cooling fans 42, as indicated by arrows A, B, C and D. Due to the airflow being formed underneath the sheet storage portion 44, the temperature of the air, which is raised by heat emission, is prevented from being trapped underneath the sheet storage portion 44. Thus, the rise in temperature of the sheet storage portion 44 can be controlled. As a result, adverse effects to the sheet-shaped recording material 12 can be prevented.

In this way, at the cooling rollers 30, the heat dissipating effect is accelerated by the cooling fins 38, and heat is forcibly dissipated by the air-cooling fans 42. Accordingly, the cooling rollers 30 can be maintained substantially at their initial temperature when the sheet-shaped recording material 12 is not present thereat. Further, as described above, the stream of air can restrain temperature rise of the sheet storage portion 44.

Figure 5:
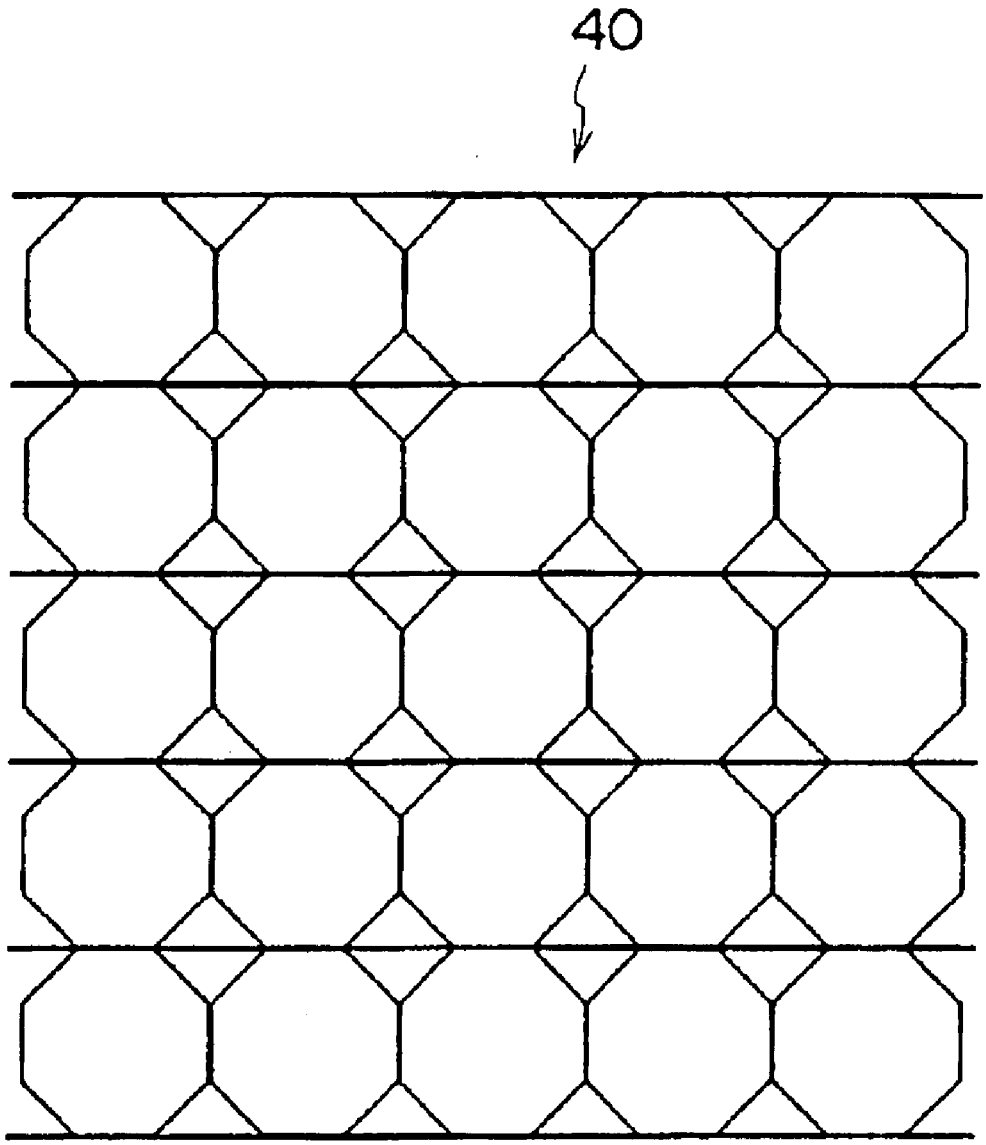
FIG. 5 is a view of a filter having a honeycomb-shaped cross section.

As shown in FIG. 5, the filter 40 disposed between the cooling fins 38 and the air-cooling fans 42 has a honeycomb-shaped cross section. The filter 40 filters the air to absorb odors of particles of benzene series, ammonium series and the like suspended in the air. Air thus filtered is then discharged by the air-cooling fans 42 to the outside (see FIG. 1).

Further, as shown in FIGS. 1 and 2, the gradual cooling section 34 has a cover 35 formed therein. Part of the gradual cooling section 34 is separated by the cover 35 such that air flowing in the ventilation passage 48 is prevented from directly contacting the upstream side (or the separated part) of the gradual cooling section 34 and the sheet-shaped recording material 12, which has just been discharged from the heat-developing section. Namely, the sheet-shaped recording material 12, which has been softened in the heat-developing section 14, can be prevented from being rapidly cooled by the airflow. As a result, rapid cooling-induced image irregularities can thereby be prevented.

Operation of the above-described embodiment will be described hereinafter.

At the exposure section 11, a latent image is formed on a sheet-shaped recording material 12. During the continued formation of the latent image, the leading end of the sheet-shaped recording material 12 enters into the insertion portion of the heat-developing section 14.

At the heat-developing section 14, the sheet-shaped recording material 12 is conveyed in a substantial arc shape and is heat-developed by the heat of the plural developing units 18. The sheet-shaped recording material 12, which has been heat-developed, is discharged from the exit portion 25 disposed at the upper portion of the heat-developing section 14. As described above, with this arrangement, volatile components can be prevented from staying in the heat-developing section 14, and therefore, it is difficult for the sheet-shaped recording material 12 to be contaminated and for electronic parts to corrode.

At the cooling section 28, the sheet-shaped recording material 12, which has been fed-out from the heat-developing section 14, is grippingly conveyed by the cooling rollers 30. First, the sheet-shaped recording material 12, which has been heated to 120° C., is cooled by the gradual cooling section 34 at a gradual rate to approximately 70° C. Thereafter, the sheet-shaped recording material is rapidly cooled to approximately 45° C. by the rapid cooling section 36. Thus, the temperature of the sheet-shaped recording material 12 discharged from the cooling section 28 can be lowered to a temperature which does not cause problems for handling by an operator.

As described above, in the present embodiment, each cooling roller 30 includes the pipe 31 with at least a base layer (or adhesive layer) in which the piles 32 are electrostatically implanted. Unlike the prior art, the present invention does not possess an arrangement in which a cooling roller is formed by a pipe and a felt sheet, which felt sheet is spirally wound on the pipe with a seam formed by both edges thereof. On the contrary, the cooling rollers 30 of the present embodiment are formed by using static electricity flock transplantation technology such that the base layers have no seam. Accordingly, uneven cooling at the cooling rollers 30 can be prevented. As a result, the occurrence of development irregularities can be effectively prevented.

Further, particularly at the rapid cooling section 36, if the heat taken away from the sheet-shaped recording material 12 remains thereat, the cooling effect deteriorates. However, by providing the cooling fins 38 and the air-cooling fans 42, the cooling section 28 can always be maintained substantially at its initial temperature.

At the sheet storage portion 44, the sheet-shaped recording material 12, which has been discharged from the discharge opening 46 via the cooling section 28, is stored on the upper surface of the cover.

The air-cooling fans 42 form an air stream which flows from the discharge opening 46 through the ventilation passage 48 to the outside of the apparatus. As described above, because of the airflow being formed underneath the sheet storage portion 44, air, which is raised in temperature by heat emission, is prevented from staying at the underside of the sheet storage portion 44. Thus, the rise in temperature of the sheet storage portion 44 can be controlled. As a result, deterioration of the sheet-shaped recording material 12 can be prevented.

The filter 40 filters an air flowing in the ventilation passage 48 to absorb odors of particles of benzene series, ammonium series and the like suspended in the air. Thus, discharging of a foul odor to the outside of the apparatus can be prevented.

The cover 35 prevents direct contacting of the air to the sheet-shaped recording material 12 which has just been discharged from the heat-developing section 14. Namely, the very same sheet-shaped recording material 12, which has been softened in the heat-developing section 14, can be prevented from being rapidly cooled by the airflow. As a result, image irregularities, which may be caused by rapid cooling, can effectively be prevented.

In the above-described embodiment, when heat-developing the sheet-shaped recording material, the duty ratio for the air-cooling fans is raised. In this case, for example, a temperature sensor, such as a thermistor, may be provided in the cooling section in order to control the duty ratio of the cooling fans.

Figure 6:
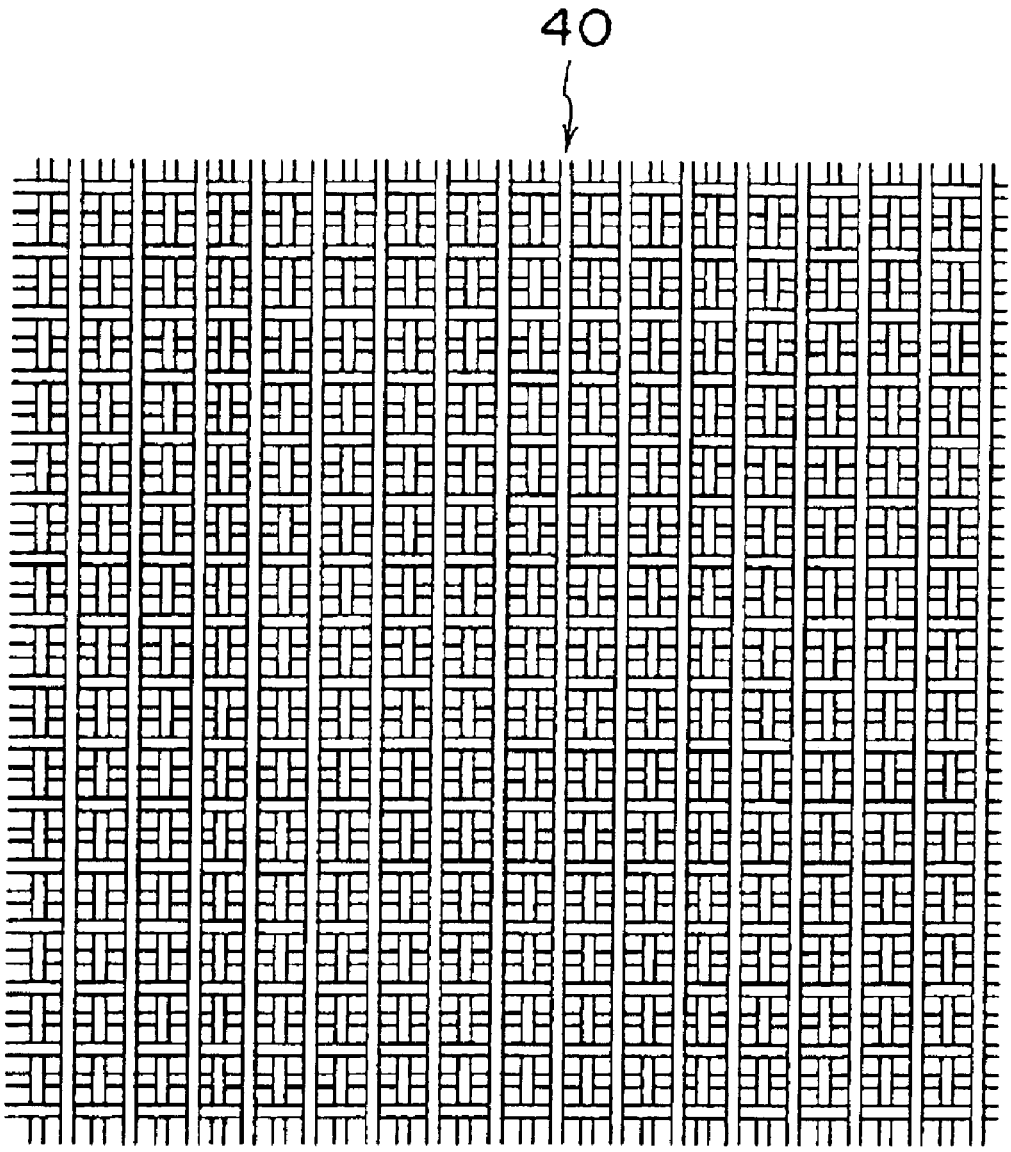
FIG. 6 is a view of another filter having a grille-shaped cross section.
Figure 7:
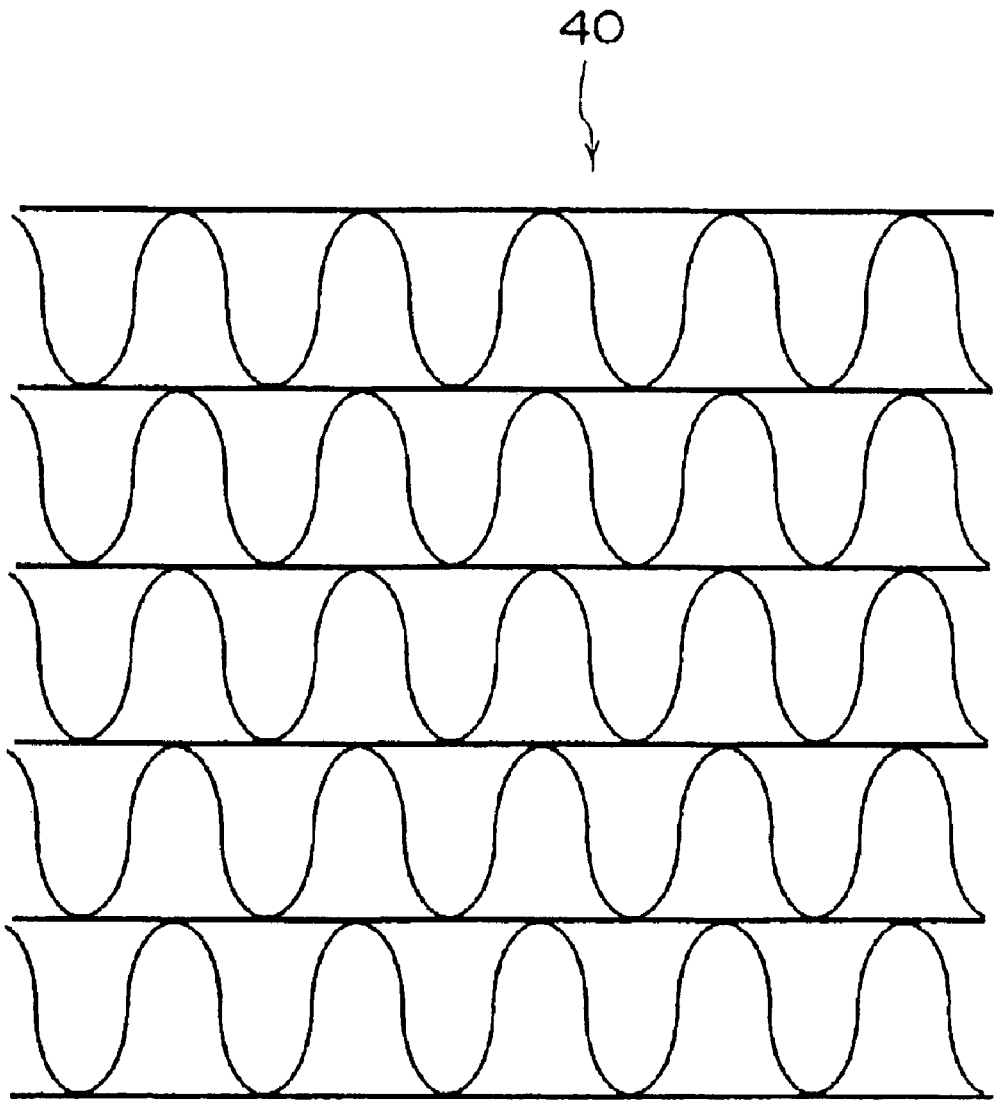
FIG. 7 is a view of yet another filter having a corrugated fiber-board shaped cross section.
Figure 8:
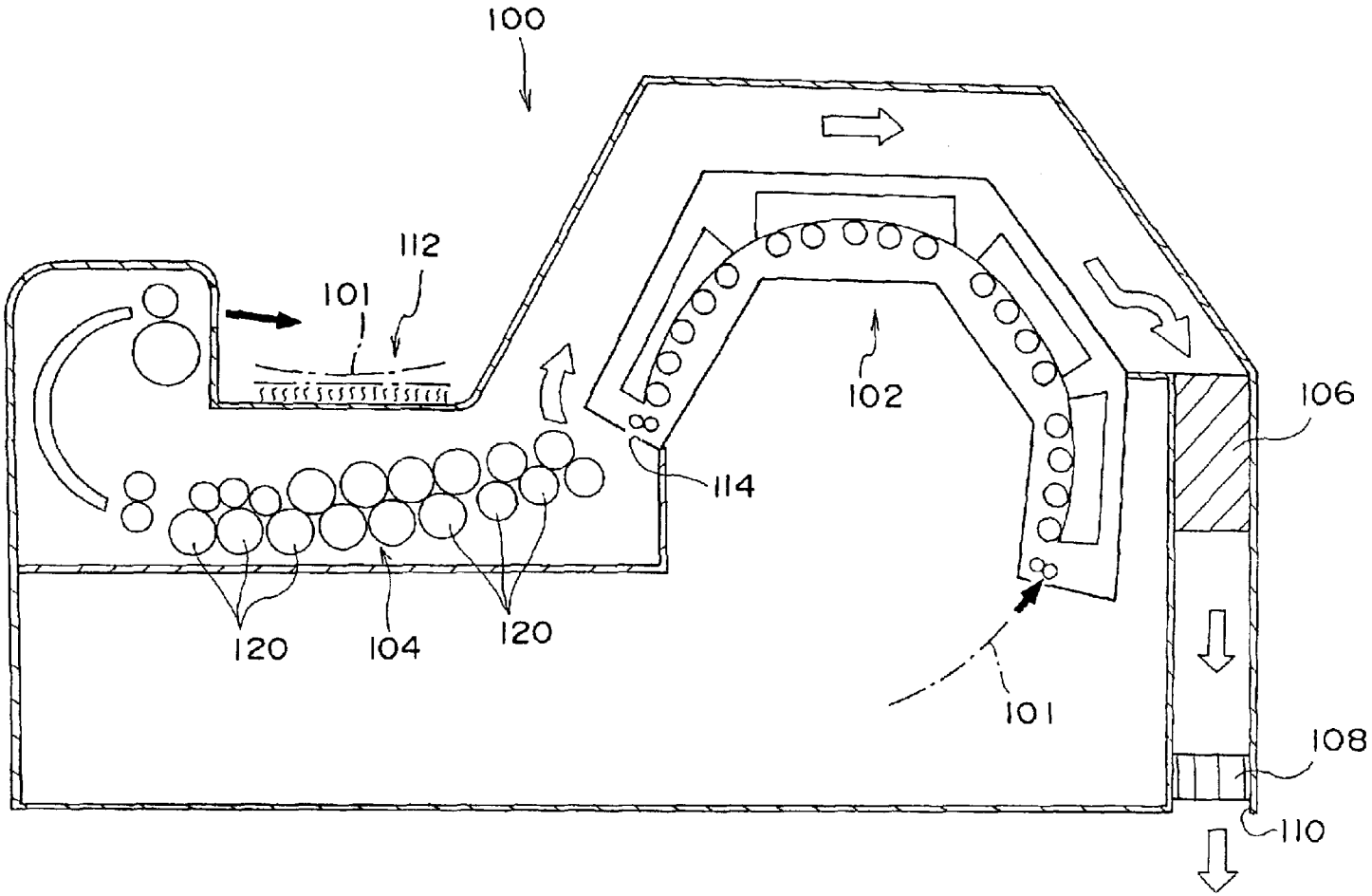
FIG. 8 PRIOR ART
FIG. 8 is a schematic general structural view of a conventional image recording apparatus.
Figure 9:
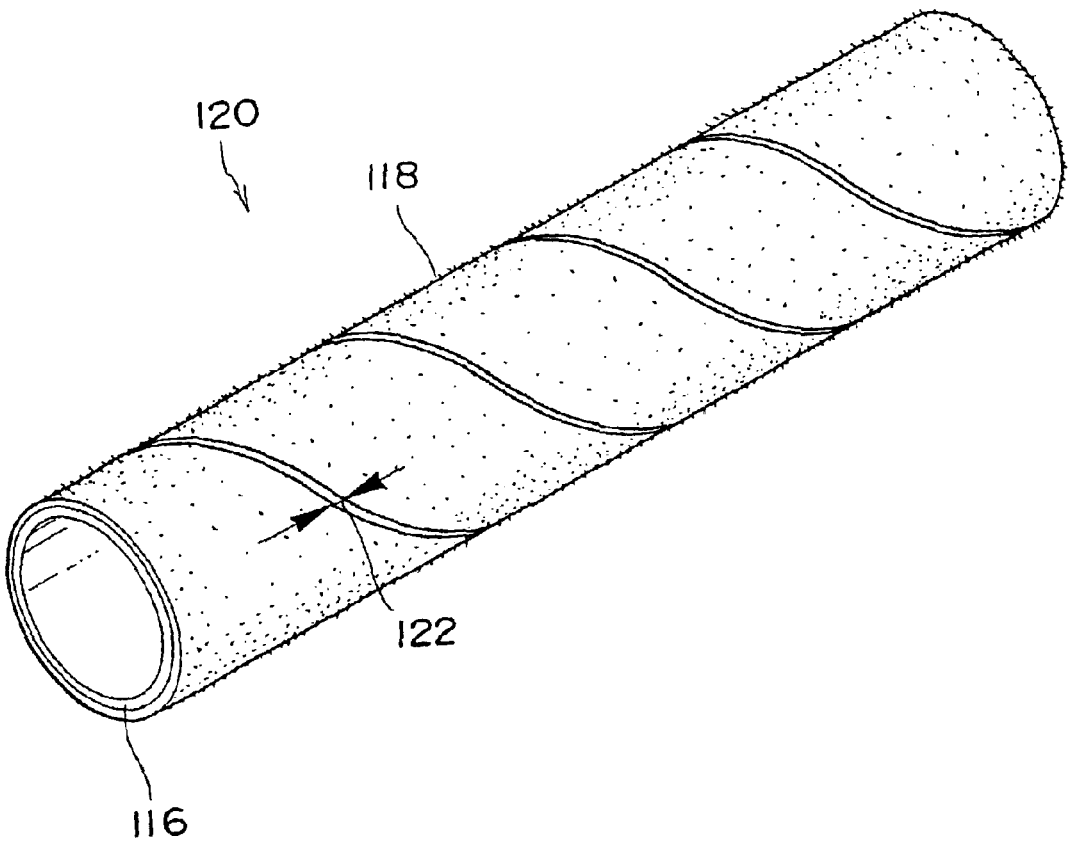
FIG. 9 PRIOR ART
FIG. 9 is a perspective view of a conventional cooling roller.

It should be noted that, in the above embodiment, a detailed description is given of a case in which the filter has a honeycomb-shaped cross section. However, the configuration of the filter is not limited to this structure. For example, a filter with a grille-shaped cross section, as shown in FIG. 6, and a filter with a corrugated fiber-board shaped cross section as shown in FIG. 7 may also be utilized.

Further, in the above-described embodiment, all of the cooling rollers, which are disposed in the cooling section 28, are of one type in which the piles are electrostatically implanted on the base layers of the cooling rollers. However, the present invention is not thus limited. For example, if necessary, only the rollers enclosed in the cover 35 may be flocked. Alternatively, only the rollers disposed in the gradual cooling section can be of this type, if necessary.

As is described above, an image recording apparatus according to the present invention has excellent effects in that the rise in temperature at the sheet storage portion can be controlled so as to prevent deterioration of the sheet-shaped recording material, in that the occurrence of development irregularities which may be caused by unevenness of cooling can be prevented, and in that the volatile components can be prevented from being trapped in the heat-developing section.

What is claimed is:

1. An image recording apparatus having a path of travel of a recording material, said apparatus comprising;

(I) an exposure section subjecting the recording material to exposure processing so as to form a latent image on the recording material;

(II) a heat-developing section subjecting the recording material to heat processing so as to carry out development, said heat-developing section being disposed downstream of the exposure section;

(III) a cooling section for cooling the recording material, said cooling section being disposed downstream of the heat-developing section; and (IV) a storage section for storing the recording material, said storage section being disposed downstream of the cooling section; and (V) wherein the heat-developing section includes an exit portion for the recording material, said exit portion being provided on the path and disposed at an upper portion of the heat-developing section such that hot air is able to escape from an inside of the heat-developing section.

2. The image recording apparatus according to claim 1, further comprising a ventilation passage that is formed between the storage section and the cooling section.

3. The image recording apparatus according to claim 2, further comprising a fan unit that is disposed downstream of the ventilation passage.

4. The image recording apparatus according to claim 3, further comprising a filter that is disposed upstream of the fan unit.

5. The image recording apparatus according to claim 4, wherein said filter comprises a honeycomb-shaped cross section.

6. The image recording apparatus according to claim 4, wherein said filter comprises a grille-shaped cross section.

7. The image recording apparatus according to claim 4, wherein said filter comprises a corrugated fiber board shaped cross section.

8. The image recording apparatus according to claim 2, wherein the cooling section includes a gradual cooling section for gradually cooling the recording material, and a rapid cooling section for rapidly cooling the recording material.

9. The image recording apparatus according to claim 8, further comprising a cover for covering part of the gradual cooling section, said part being disposed in an upstream portion of the gradual cooling section in order for air in the ventilation passage not to directly strike said part.

10. The image recording apparatus according to claim 2, further comprising a plurality of cooling fins which are provided within the ventilation passage.

11. The image recording apparatus according to claim 10, wherein the cooling fins extend substantially parallel with one another.

12. The image recording apparatus according to claim 10, wherein the cooling fins hang down from an inside surface of a cover of the image recording apparatus.

13. The image recording apparatus according to claim 2, wherein the cooling section includes a discharge opening which is provided on the path and disposed upstream of the ventilation passage.

14. The image recording apparatus according to claim 1, wherein the storage section is disposed at an upper side of the cooling section.

15. The image recording apparatus according to claim 1, wherein the upper portion of the heat-developing section comprises the upper most point of the path of travel.

16. An image recording apparatus having a path of travel of a recording material, said apparatus comprising:

(I) an exposure section subjecting the recording material to exposure processing so as to form a latent image on the recording material;

(II) a heat-developing section subjecting the recording material to heat processing so as to carry out development, said heat-developing section being disposed downstream of the exposure section;

(III) a cooling section for cooling the recording material, said cooling section being disposed downstream of the heat-developing section; and (IV) a storage section for storing the recording material, said storage section being disposed downstream of the cooling section;

(V) wherein the cooling section includes a plurality of cooling rollers, which are disposed along the path, at least part of said cooling rollers having had electrostatic implantation performed thereon.

17. The image recording apparatus according to claim 16, wherein each of said at least part of the cooling rollers includes a pipe and a plurality of brush members that are implanted on the periphery of the pipe by electrostatic implantation.

18. The image recording apparatus according to claim 16, wherein the cooling section includes a gradual cooling section for gradually cooling the recording material, said gradual cooling section having a plurality of cooling rollers, and a rapid cooling section for rapidly cooling the recording material, said rapid cooling section having another plurality of cooling rollers.

19. The image recording apparatus according to claim 18, further comprising a cover for covering part of the gradual cooling section, said part being disposed in an upstream portion thereof in order to prevent air in the ventilation passage from directly striking said part.

20. The image recording apparatus according to claim 16, wherein the heat-developing section includes an exit portion for the recording material, said exit portion being provided on the path and disposed at an upper portion of the heat-developing section such that hot air is able to escape from an inside of the heat-developing section.

21. The image recording apparatus according to claim 16, wherein said plurality of cooling rollers comprise a pipe portion wherein piles are electrostatically implanted in said pipe portion.

22. The image recording apparatus according to claim 21, wherein said piles have a length dimension in the order of 0.1 mm to 4 mm and a thickness dimension in the order of 1.5 denier to 30 denier.

23. The image recording apparatus according to claim 16, wherein said plurality of rollers comprise:

an adhesive; and a plurality of piles;

wherein said plurality of piles are exposed on an external surface of said plurality of rollers with application of an electric field.

24. The image recording apparatus according to claim 23, wherein said piles have a length dimension in the order of 0.1 mm to 4 mm and a thickness dimension in the order of 1.5 denier to 30 denier.

* * * * *